US005566395A

United States Patent [19]

Nebeker

[11] Patent Number: 5,566,395

[45] Date of Patent: Oct. 22, 1996

[54] LINER FOR HAT

[76] Inventor: Leonard R. Nebeker, 2464 E. Murray-Holladay Rd., Salt Lake City, Utah 84117

[21] Appl. No.: 277,891

[22] Filed: Jul. 20, 1994

[51] Int. Cl.[6] ..... A42C 5/02

[52] U.S. Cl. ..... 2/181; 2/181.4; 2/182.1; 2/182.2; 2/183; 2/195.2; 2/418; 2/DIG. 11

[58] Field of Search ..... 2/171.2, 181, 181.2, 2/181.4, 183, 195.2, 418, DIG. 11, 182.1, 182.2

[56] References Cited

U.S. PATENT DOCUMENTS

| | | | |
|---|---|---|---|
| D. 317,523 | 6/1991 | Smith | D2/261 |
| 3,839,138 | 10/1974 | Kyle et al. | 428/287 |
| 3,906,548 | 9/1975 | Kallis | 2/181.4 |
| 4,274,157 | 6/1981 | Boden | 2/181.4 |
| 4,547,903 | 10/1985 | Brown et al. | 2/12 |
| 4,630,317 | 12/1986 | Brown et al. | 2/12 |
| 4,634,438 | 1/1987 | Sustmann et al. | 604/376 |
| 4,856,116 | 8/1989 | Sullivan | 2/181 |
| 5,025,504 | 6/1991 | Benston et al. | 2/181.4 |
| 5,033,122 | 7/1991 | Smith | 2/181 |
| 5,313,668 | 5/1994 | Bogan et al. | 2/181.4 |
| 5,315,715 | 5/1994 | Kronenberger | 2/DIG. 11 |
| 5,418,981 | 5/1995 | Miner | 2/181 |
| 5,471,683 | 12/1995 | Moretz et al. | 2/181 |

*Primary Examiner*—Diana Biefeld
*Attorney, Agent, or Firm*—A. John Pate; Berne S. Broadbent; Gary D. E. Pierce

[57] ABSTRACT

A disposable liner is fitted against the inside surface of a sweatband of a cap or hat. The liner functions to absorb moisture and oils, and to eliminate odor. The liner wicks moisture away from a user and may hold moisture away from the hat. The liner may wick moisture to an evaporation region to be evaporated. The evaporation region may be separated from the hat by a cover layer to prevent wicking into the crown of the hat. The liner may be configured to adjust the size, and thus the fit of the hat on the head of the user. To secure a hat on the head of a user, the liner may include a compressible, foamed, polymeric core. The core may be treated with an antibacterial agent and a deodorizing agent for eliminating odors. To one side of the core is attached an adhesive layer for securing the to the sweatband of the hat. The adhesive is selected for firmness yet easy removal and disposal of the liner. The adhesive may be heat-sensitive. Multiple layers of foamed polymeric substrates coated on two sides with adhesive may be adhered to one another for sizing a hat. The other side of the core is bonded to a fabric layer positionable against the forehead of a user. The fabric layer may be formed to have an absorbent layer, and may include a non-absorbent outer layer that transfers moisture but remains dry to the touch.

20 Claims, 11 Drawing Sheets

LINER FOR HAT

BACKGROUND

1.Field of the Invention

This invention relates to hats and caps, and more particularly to a disposable liner for fitting inside the sweatband of a cap or hat.

2.State of the Art

Typical hats or caps have a band positioned inside the crown near the brim, commonly called a sweatband. The sweatbands of many commercially available hats are not configured to absorb moisture from the forehead of the user or to absorb odors. To the extent that a sweatband does absorb moisture, it cannot be cleaned or removed, thus, eventually soiling the hat. Typical sweatbands are flexible, but do not stretch. Thus, typical sweatbands actually serve to prevent the hat from changing size.

Hats and caps such as those displaying sport team logos or product names are made of various materials such as nylon, twill, duck, cotton, wool, canvas, net or corduroy. Some of these materials are not readily washable or lose their shapes when washed. Further, some hats or caps contain materials or construction (e.g. fiberboard visors) that prohibit washing of the hat or cap, requiting custom cleaning techniques.

A for hats or caps that functions to absorb moisture and control odor is desirable for protecting hats and caps from damage.

SUMMARY

A for use on headware such as a cap or hat, including billed, brimmed and other styles, has a sweatband or equivalent. The liner is an elongated strip having a length, bounded by two ends, a width bounded by two edges, and first and second surfaces or faces extending between the ends and the edges. The is positionable on and along the sweatband, either along the entire circumference or just on the brow area at the front of a hat. The finer may be made to be disposable.

The liner has a core having a first surface and a second surface. An adhesive layer applied to the first surface of the core secures the liner to the sweatband. The adhesive is selected so that the may be removed by pulling the liner directly away from the sweatband. Removal may be facilitated by, or may require, application of heat to soften or release the adhesive layer.

An absorbent layer, comprising wicking material is affixed to the second surface of the core for absorbing moisture and oil from the forehead of the user. The wicking material may be a natural fiber such as cotton or paper. Thick fabrics such as terry cloth may be used.

The core of the liner may be comprised of a compressible material, such as expanded polymers and elastomers, including natural robber, latex, urethane or polyethylene, for snugly holding a hat on the head of a user. The core may be comprised of a closed-cell polymer foam or open-cell polymer foam. The core may be treated with an odor absorbing material, charcoal, an antibacterial agent or a combination thereof to act as a deodorizer, preventing and eliminating odors. Deodorizing may also include application of fragrances.

The core and absorbent layer may be folded over at one edge, both edges or no edge with different effects. A single fold may give a finished appearance to the resultant edge. A double fold may give the same result at both edges.

A liner attachable to a sweatband of a hat may be configured to prevent liquids from wicking to the hat and may wick to an evaporative region of the liner. The liner may include an elongated core positionable in an orientation along the sweatband of the hat.

The liner may have a thickness to adjust the circumference of the sweatband, and the first layer may include a plurality of spacing layers selectively attachable to one another in stacking fashion in the thickness direction to alter the thickness of the liner. Each spacing layer of the plurality of spacing layers may have first and second faces coated with an adhesive. The core, the first layer, the second layer, any of them, or all of them may be made of a resilient material for securing the liner and hat snugly to the head of a user.

The second layer may be a selective wick that draws moisture away from other parts of the liner, such as from an open-cell foam core. Thus, sweat would be drawn from the core to be distributed and evaporated. More valuable is an ability of the second layer to wick liquids such as water and oils away from the material of the hat. A material fiber having a smaller pore size than that of the material of the hat may be selected to draw and hold moisture away from the hat. Cotton is effective to hold or to draw liquids from wool or synthetic fibers. Paper products may be formed to draw likewise from many fibers and fabrics.

The liner may be foldable to create a fold near one edge, or at both edges, extending circumferentially (longitudinally). The liner may be selectively foldable by a user to adjust (shape) the width or thickness of the liner. Alternatively, the back side (away from the second layer) of the core may be beveled at its edges before an adhesive is applied on, with, to or as the first layer. The bevel resulting at the edges of the liner facilitates adhesion of the second layer virtually flush with the sweatband. Thus, the liner has a thin profile and finished appearance at the edges.

BRIEF DESCRIPTION OF THE DRAWINGS

The invention is shown in various embodiment in the following illustrations, in which.

DETAILED DESCRIPTION OF THE PREFERRED EMBODIMENTS

Figure 1:
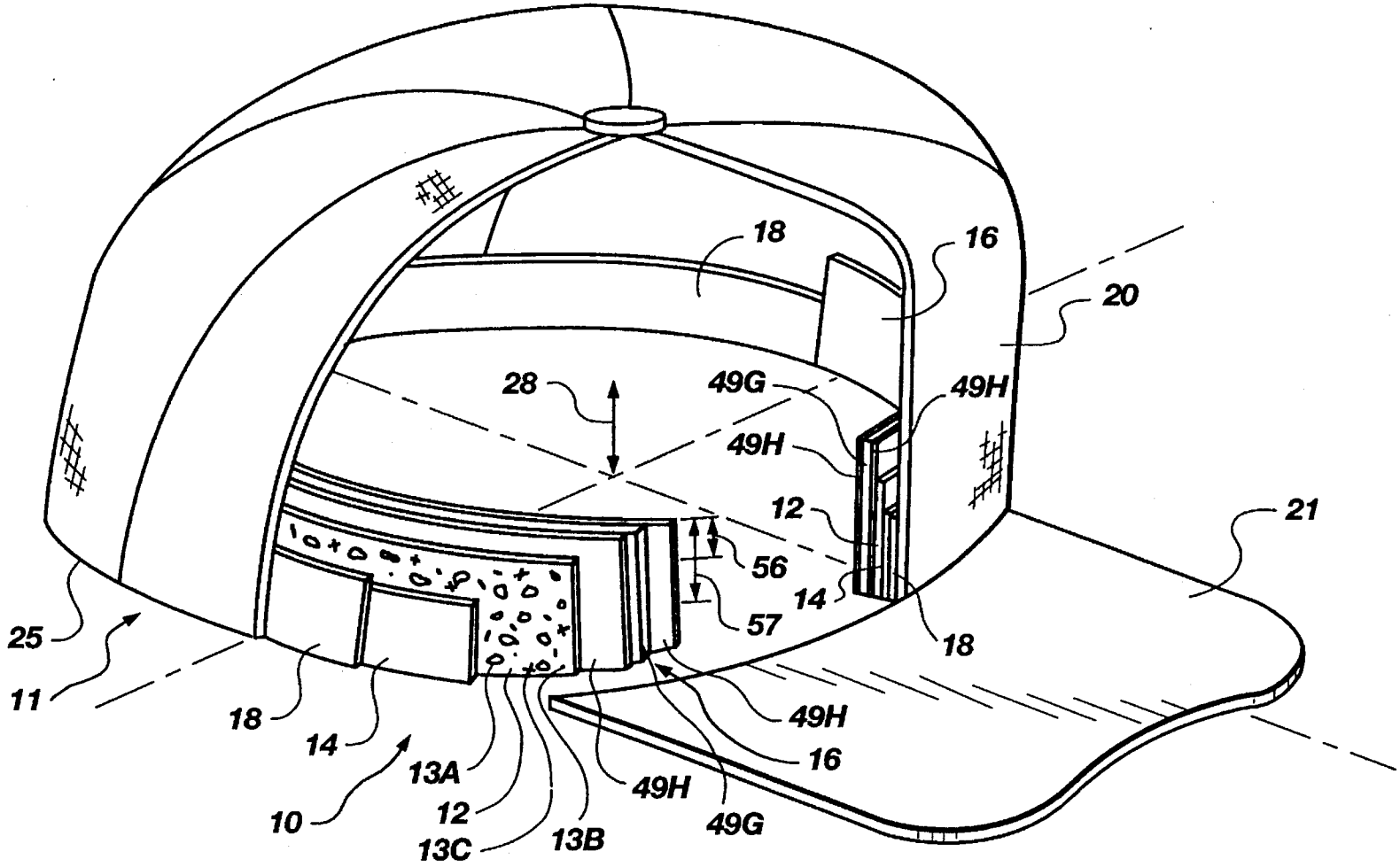
FIGS. 1–3 are partially cutaway, front quarter isometric views, of a liner for a hat.

The invention is best understood by reference to FIGS. 1–11B illustrating a hat liner or liner 10 for fitting inside a hat 11, and made according to the invention. The liner 10 has a core layer or core 12 to which an adhering layer 14 is attached opposite an absorbing layer 16. The liner 10 is configured to be securable by the adhering layer 14 to the sweatband 18 in the crown 20 of the hat 11. The sweatband 18 is typically sewn inside the crown 20 to extend the entire circumference 25 of the head or the crown 20 as shown. The absorbing layer 16 is positionable at the time of installation of the liner 10 on a sweatband 18 to contact the head of a user in lieu of the sweatband 18.

Figure 2:
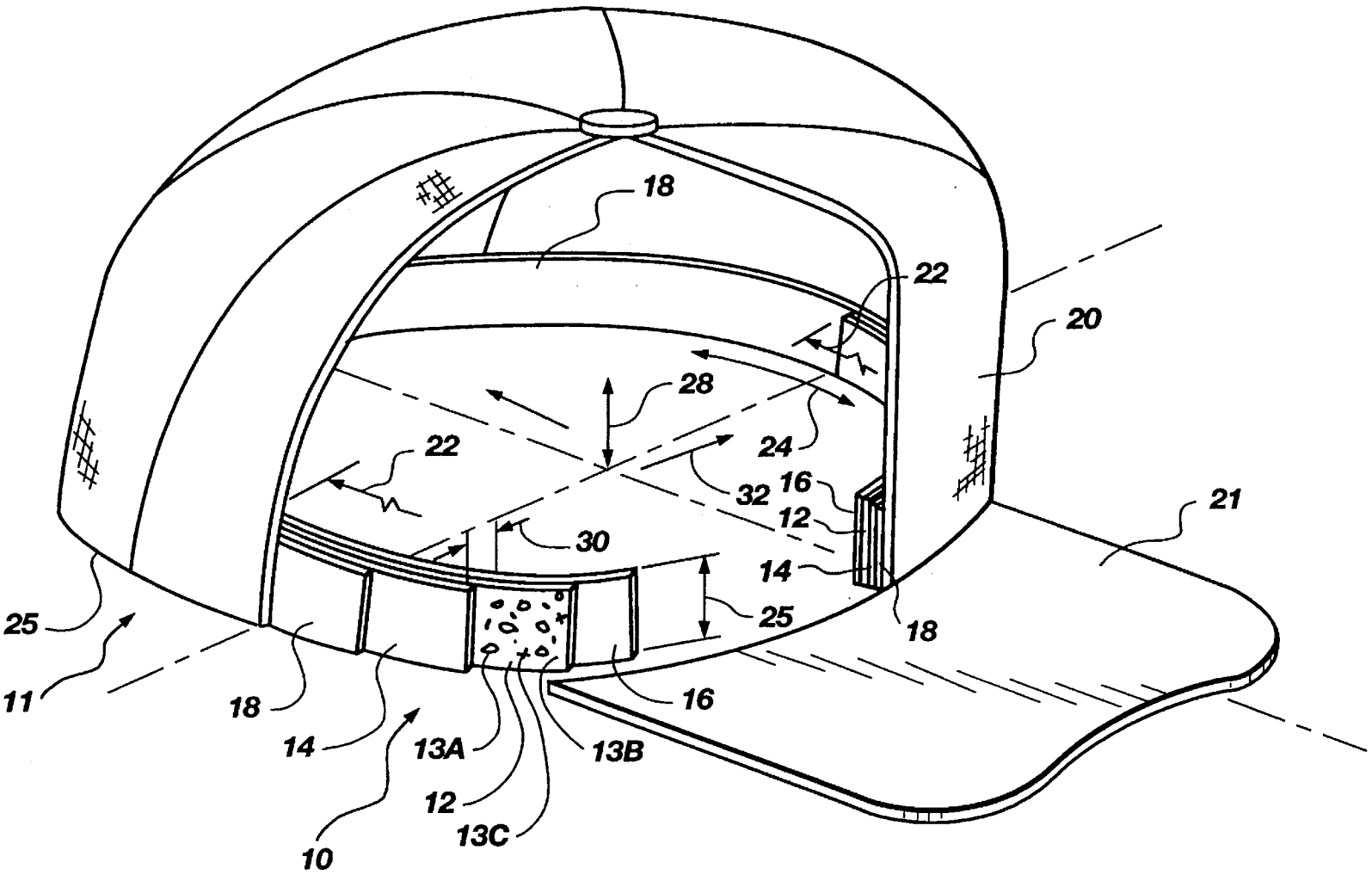
Figure 3:
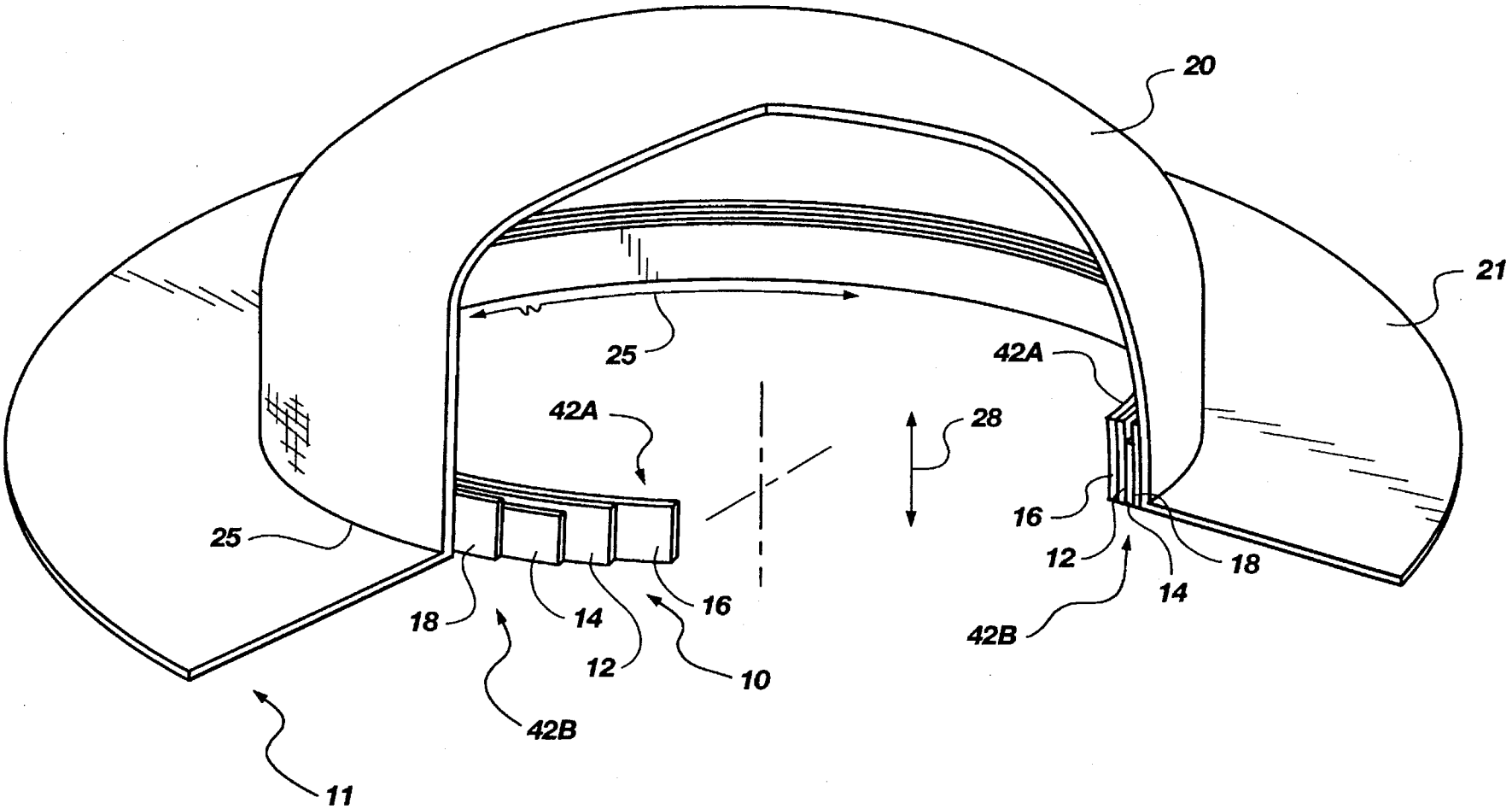

In FIGS. 1–3, the liner 10 is positioned in a hat 11. The liner has a circumferential (also called longitudinal) arcuate length or length 22. The length 22 may be such that the liner 10 is positionable to extend only about the forehead or brow of a user as in FIGS. 1–2. Alternatively, the length 22 may be sufficient to extend in the circumferential direction 24 completely around the circumference 25 of the sweatband 18 of the hat 11, as in FIG. 3.

Figure 4A:
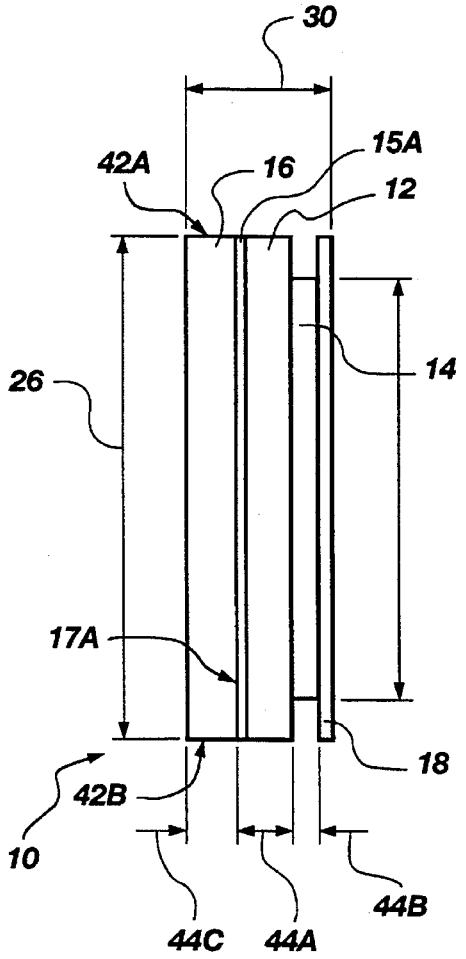
FIGS. 4A–4D are cross-sectional end elevation views of alternative embodiments of a liner for a hat.

As illustrated in FIG. 4A, the width 26 is selected to extend in an axial direction 28 to cover the sweatband 18 of the hat 11. However, the thickness 30 of the liner 10, in the radial direction 32, may be selected to meet one of several different criteria including thinness of profile or thickness for adjustment of (sizing) the hat 11.

The liner 10 may be constructed in several effective configurations, each securing certain distinct advantages. The construction and installation of the liner 10 may vary as illustrated in FIGS. 1–11B, affecting the width 26, thickness 30, length, or any combination thereof. In several embodiments, a user may have the option to selectively alter the length 22, width 26 or thickness 30 of the liner 10 prior to installation of the liner 10 in the hat 11.

STRUCTURAL CONSTRUCTION

Structural construction of the liner 10 is best understood by referring to FIGS. 1–11B. In FIGS. 1–3 the liner 10 is formed of at least three layers, the core 12, the adhering (first) layer 14, and the absorbing (second) layer 16. In this configuration of FIG. 3, the length 22 of the liner 10 extends around the entire circumference 25 of the crown 20 of the hat 11. The core 12 may be a flexible solid, but is preferably formed of an expanded polymer.

The core 12 may be comprised of a foamed polymer such as polyethylene, polystyrene, natural rubber, any synthetic rubber, latex, polyurethane or the like. The foamed polymeric material of the core 12 may be of closed-cell or open-cell type, and may be treated by coating, impregnating, molding or diffusion to include deodorizing agents such as a chemical absorbing agent 13A, like charcoal, antibacterial agent 13B, fragrance 13C, or a combination thereof.

Open cell foam typically is impervious to liquids, while open-cell foam is usually absorbent. If open-cell foam is used, potential absorption of the liner 10 may be increased. In such a construction, the adhesive layer 14 may be impermeable, or may be a substrate having adhesive disposed thereon to be impermeable (see FIG. 10).

If an open-cell foam core 12 is used that is not impervious to liquids, an adhesive layer (first layer) 14 can be made permeable or non-continuous to pass liquids to the hat. However, such a configuration is primarily useful where the liner 10 is designed only as a sweatband for the user, not to protect the hat 11. To protect the hat 11, the core 12 should have an impermeable skin or layer 15A (see FIG. 4A) on at least one side 17A and may be made entirely of an impermeable material. An impermeable material (liquid barrier) may be attached to, or formed integrally with, the core 12, the first layer 14, or both, to prevent passage of liquids such as water and oil to the crown 20 of the hat 11. Alternatively, the adhering (first) layer 14 may include a continuous and impervious material.

In the liner 10 of FIGS. 4A–9B, the core 12, adhering layer 14 and absorbing layer 16 may each be formed as a monolithic unit of a single material. The layers 12, 14, 16 are stacked in a radial direction 32 and bonded together by heat, solvent, seams or intermediate adhesive° A tab portion 34A may be folded at a bend 36A to size or edge the liner, but may be trimmed off, or left unfolded.

Figure 5A:
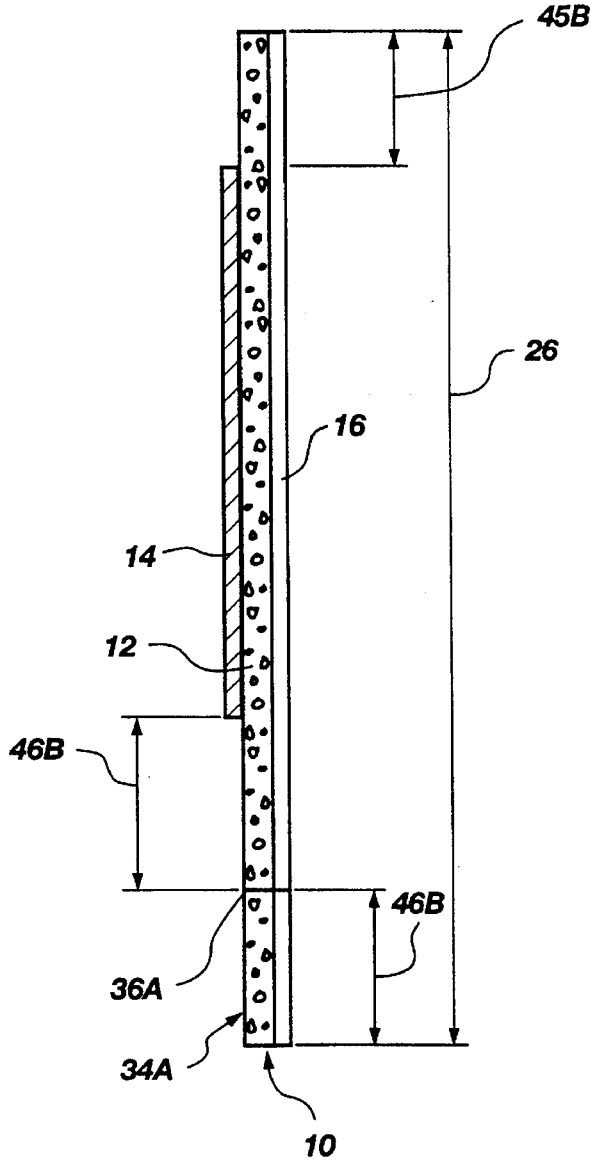
FIG. 5A is a cross-sectional end elevation view of an unfolded, alternate embodiment of the liner of the invention.
Figure 5B:
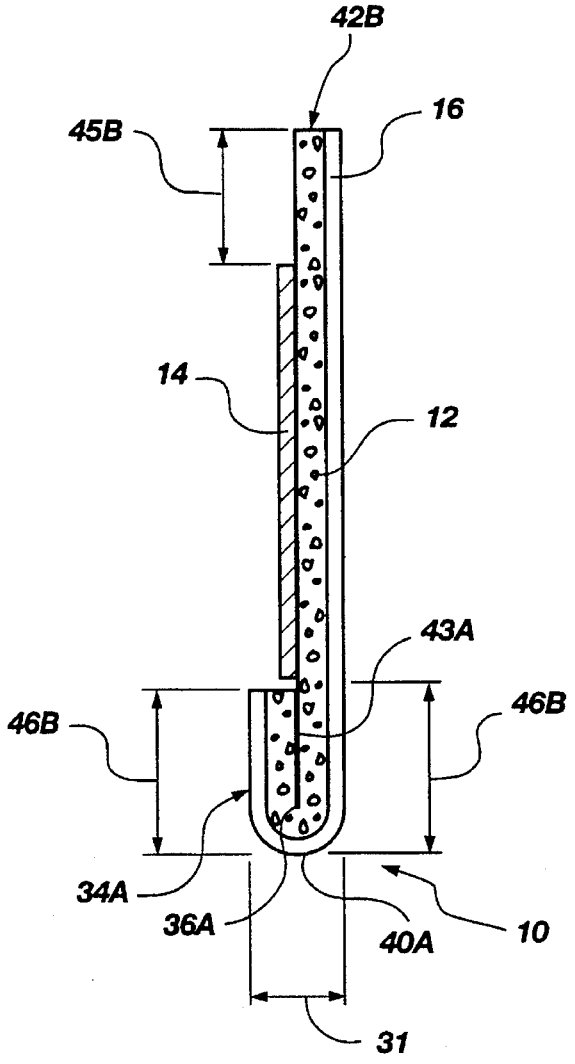
FIG. 5B is a cross-sectional end elevation view of the liner of FIG. 5A in a folded configuration.

The liner 10 may be sewn to itself (see FIG. 5C) to make a permanent fold 36A; or it may be bonded by heat, solvent, glue or the like (see FIG. 5B). The tab portion 34A may be secured by an adhesive layer 14 folded back on itself, or by folding the core 12 back over an adhesive layer 14 covering part of the core (see FIG. 6A–7C).

FIG. 4A illustrates the basic configuration of the liner 10 installed in the hat of FIG. 3. The individual thicknesses 44A, 44B, 44C, corresponding to the core 12, adhering layer 14, and absorbing layer 16, respectively, may be selected to alter the thickness 30 of the liner 10.

A liner 10 with the tab portion 34A absent or not folded fits more closely against the sweatband 18 with a thinner profile (thickness,30) as in FIG. 4A. The core 12 and an absorbent layer 16 may be folded, or the absorbent layer 16 alone may be folded. The tab portion 34A of the liner 10 may be folded to remain against the inside face 38A, the sweatband 18, or may be folded over against the outside face 38B, between the sweatband 18 and the crown 20 of the hat 11 as in FIG. 4B. The tab portion 34A may form a finished edge 40A, with a free edge 42B remaining opposite. The length 46A of the tab portion 34A may be selected to control the effective width 26 of the liner, and the position of the free edge 42B proximate the brim 21.

Figure 4B:
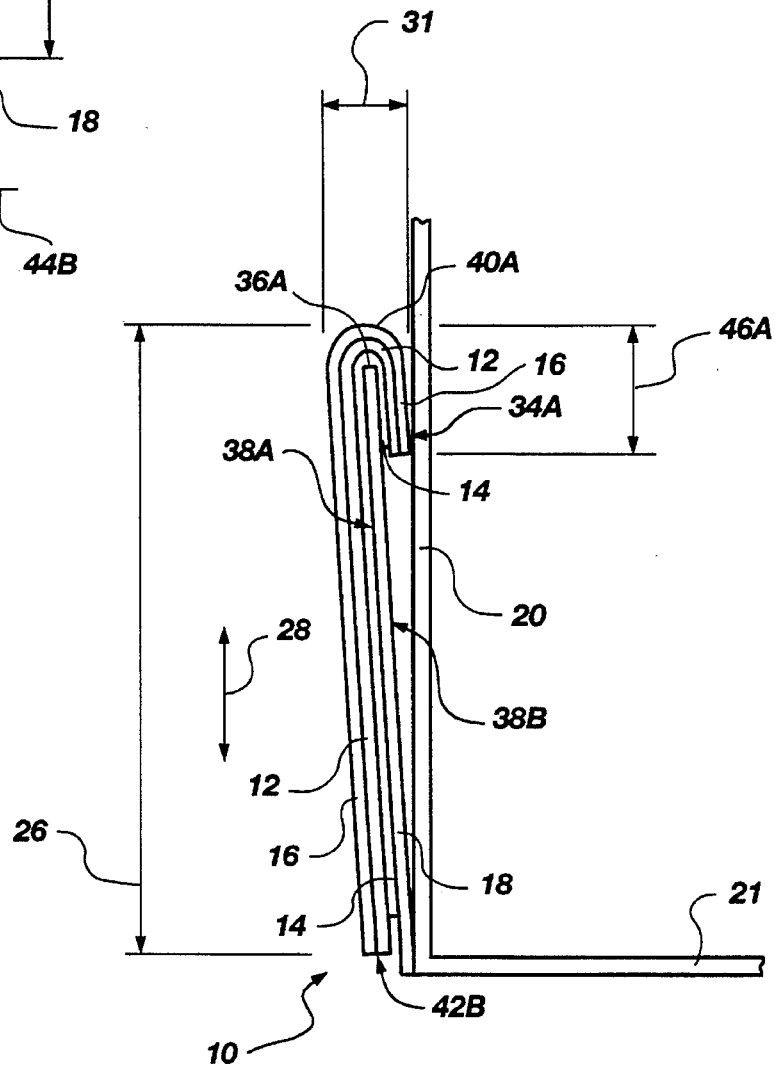
Figure 4C:
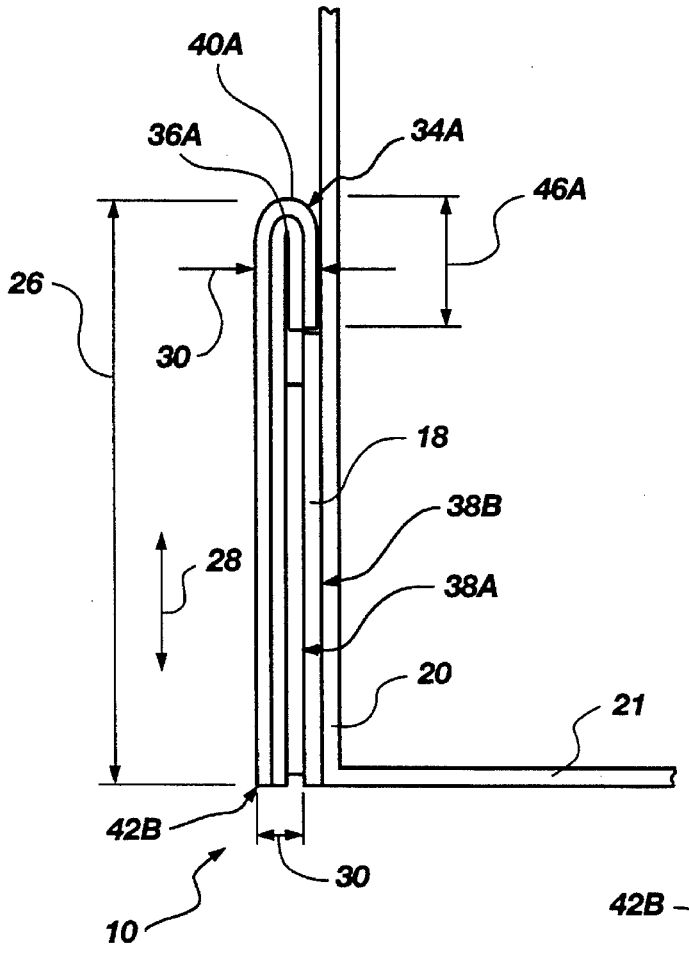

FIG. 4C illustrates a liner 10 having a tab portion 34A folded along the circumferential direction 24 at a fold 36B, but positioned on the inside face 38A of the sweatband 18. The core 12 is bonded to itself by solvent, glue or similar mechanism distinct from the adhering layer 14. The adhering layer 14 does not contact the sweatband 18 along the entire width 26 of the liner 10, but may be disposed to extend along the entire width 26 after the tab portion 34A is folded.

Figure 4D:
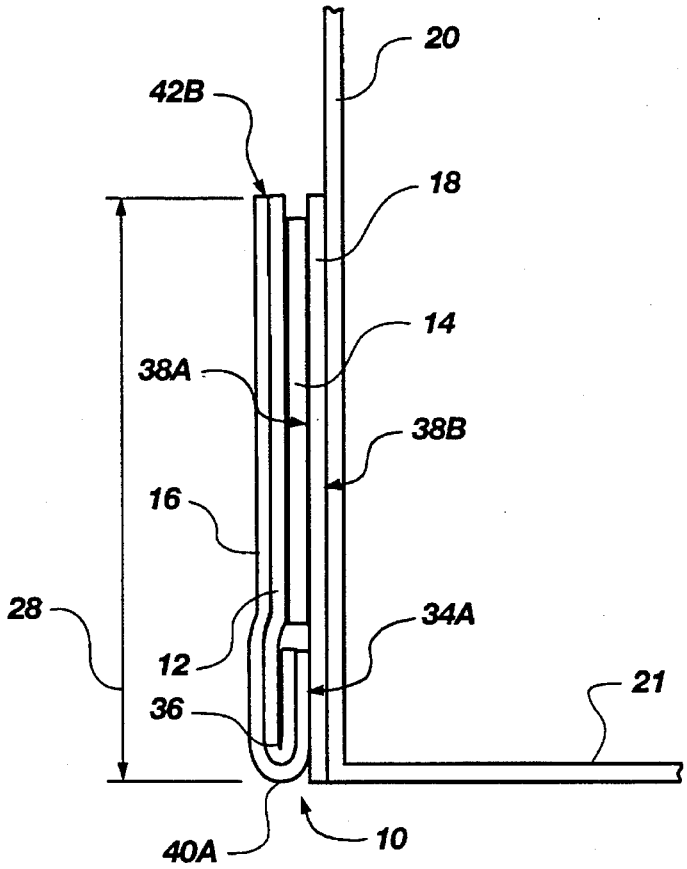

FIG. 4D illustrates a configuration similar to the configuration of FIG. 4C, with respect to the liner 10. However, the liner 10 is oriented with the finished edge 40A positioned proximate the brim 21. The effective thickness 31 of some configurations may vary (bulge) due to the folding of the tab portion 34A, or a layer such as the core 12 may be thinned prior to folding to maintain a uniform effective thickness 31 after folding.

FIG. 5A is an unfolded liner 10, also called a "blank" which can be folded at the bend 36A to the configuration of FIG. 5B. The core 12 is bonded at face 43A to itself along the distance 45A. Alternatively, as in FIG. 5C, the liner can be stitched with thread 47. A distance 45B for clearance from the free edge 42B may be provided for the adhering layer 14.

Figure 6A:
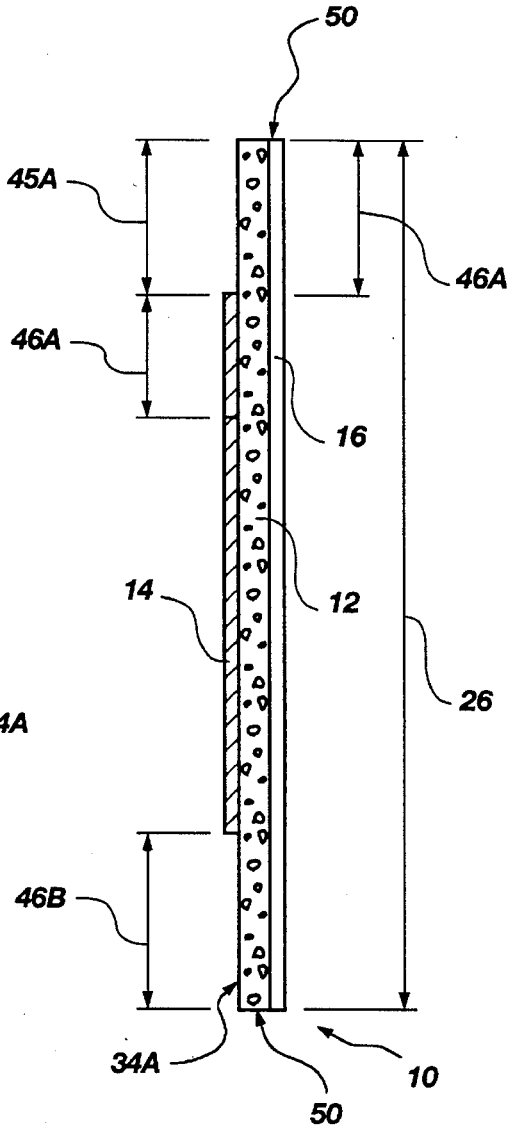
FIG. 6A is a cross-sectional end elevation view of an alternate embodiment of the liner in an unfolded configuration.
Figure 6B:
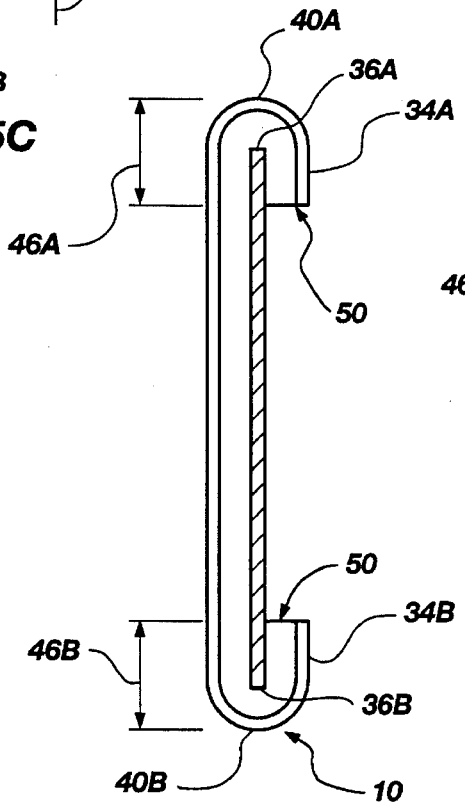
FIG. 6B is a cross-sectional end elevation view of one alternate embodiment of the liner of FIG. 6A, folded at both edges.
Figure 7A:
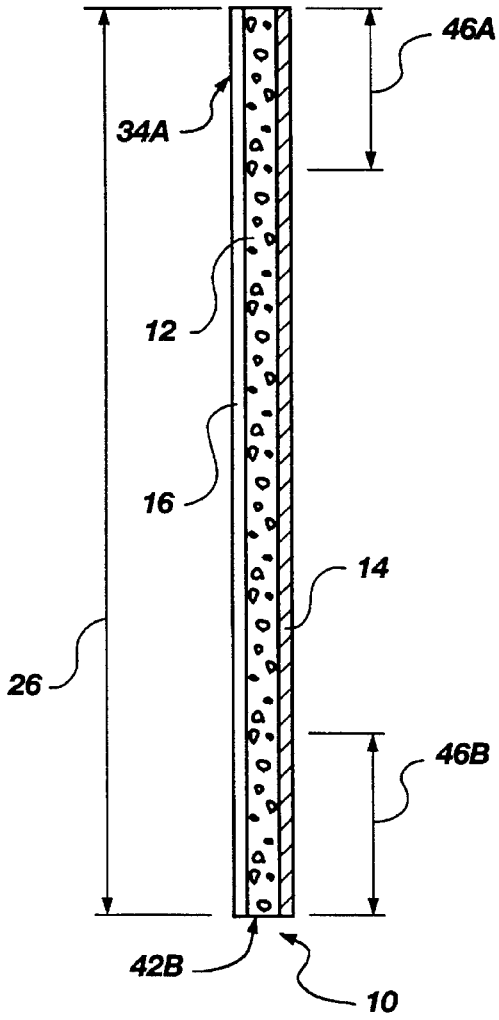
FIG. 7A is a cross-sectional end elevation view of an unfolded, alternate embodiment of the invention.
Figure 7B:
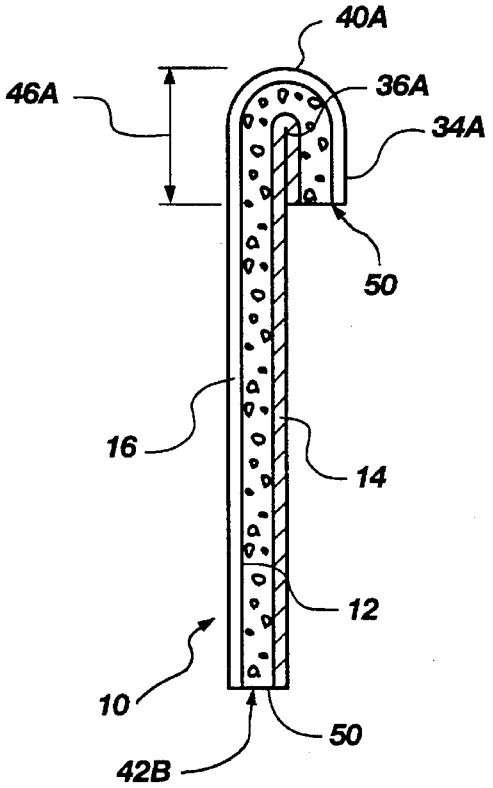
FIG. 7B is a cross-sectional end elevation view of the liner of FIG. 7A, folded at one edge.
Figure 7C:
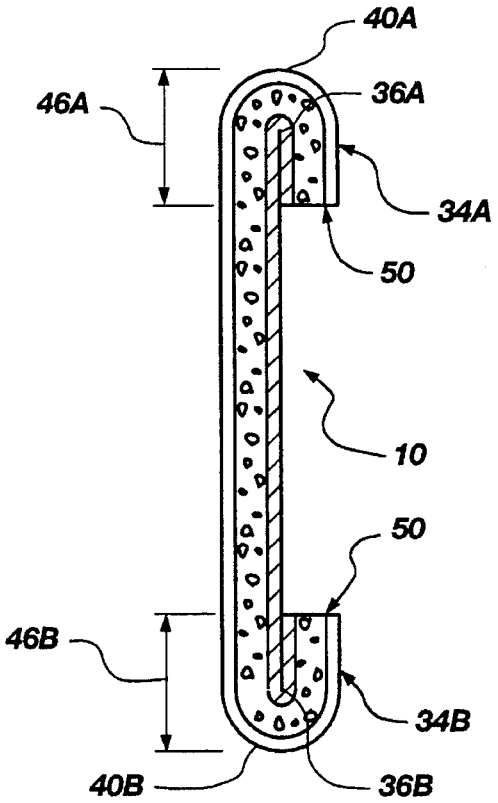
FIG. 7C is a cross-sectional end elevational view of the liner of FIG. 7A, folded at both edges.

FIG. 6A is a blank of the liner 10 of FIG. 6B. The length 46A of the tab portion 34A is folded over along the fold 36A to contact the adhering layer 14. The adhering layer 14 binds the tab portion 34A to form the finished edge 40A, rather than any distinct bonding means or the thread 47. The width 46A may optionally serve as the width 45B of clearance between the free end 42B and the adhering layer 14 (see FIG. 5B) is to prevent a tacky, adhesive result when edge 50 is exposed to an environment from which dust and debris may collect. Both widths 45A, 45B may be sufficient to permit two tab portions 34A, 34B to be folded along bends (folds) 36A, 36B to be secured to the adhering layer 14, FIG. 7A illustrates a blank for the liner 10, provided with an adhering layer 14 extending along virtually the entire width 26. The blank 10 may be folded as in FIG. 7B or as in FIG. 7C. The tab portions 34A and 34B can be formed to be of any practical width 46A, 46B, respectively, and may even overlap one another. A method of adhering the liner to the sweatband may include placing the tab portion 34A on the outer face 38B of the sweatband 18 as illustrated in FIG. 4B. Trimming and overlapping the tab portions 34A, 34B provides three optional thicknesses 30 for the liner inside the sweatband, corresponding to one, two or three stacks of the three layers 12, 14, 16.

Figure 5C:
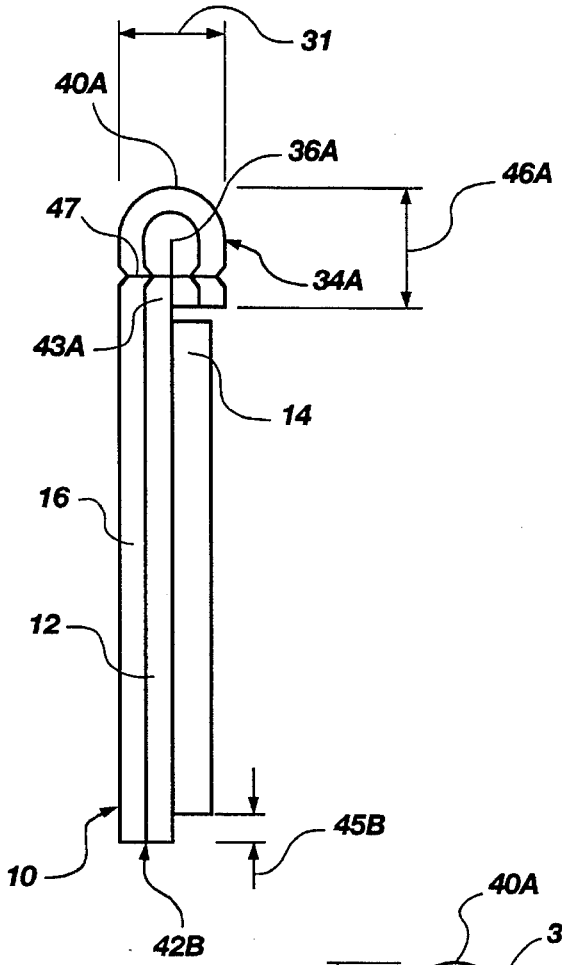
FIG. 5C is a cross-sectional end elevation view of a folded, sewn alternate embodiment of the liner of the invention.
Figure 8A:
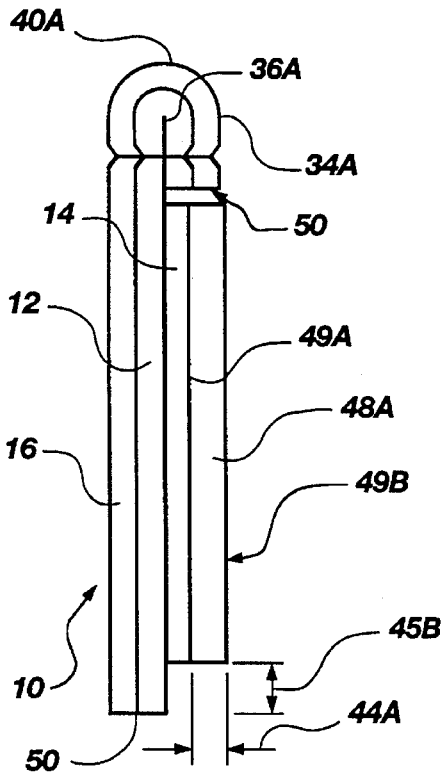
FIGS. 8A–9B are cross-sectional end elevation views of alternate embodiments of the invention having thickness layers added.

FIG. 8A illustrates how the thickness 30 and effective thickness 31 of the liner of FIG. 5C may be adjusted by addition of a buildup layer 48A. The buildup layer 48A adheres at the face 49A, which may be adhesive-coated or not, to the adhering layer 14. Thus, the adhering function of the adhering layer 14, with respect to the sweatband 18 is replaced by the face 49B which is adhesive.

Figure 8B:
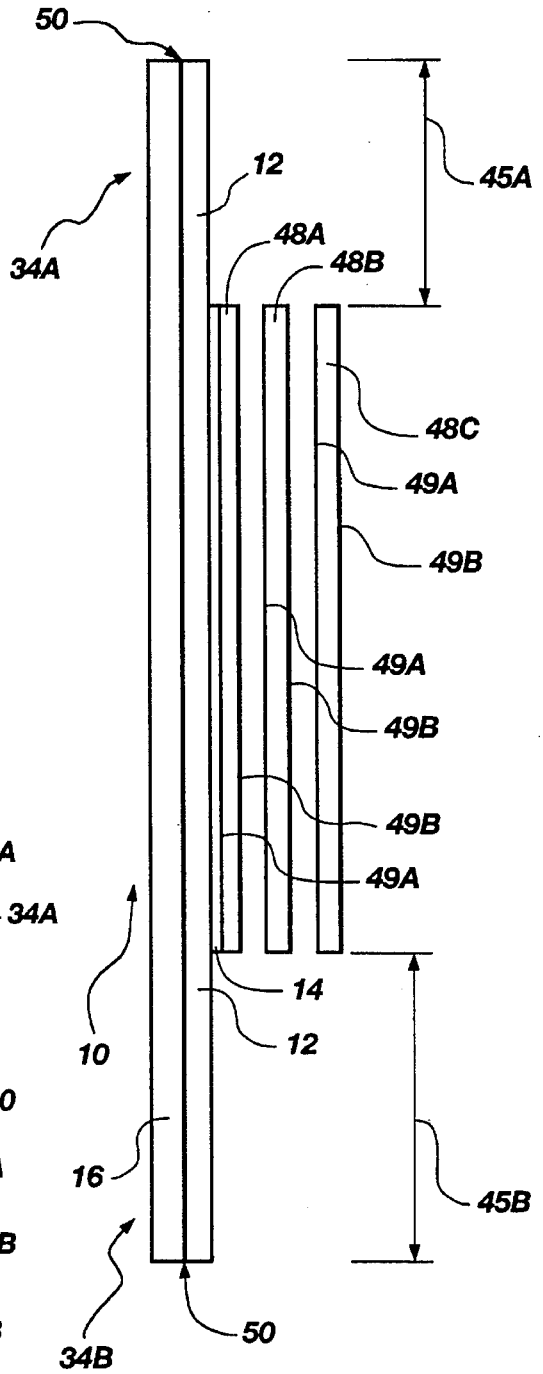
Figure 8C:
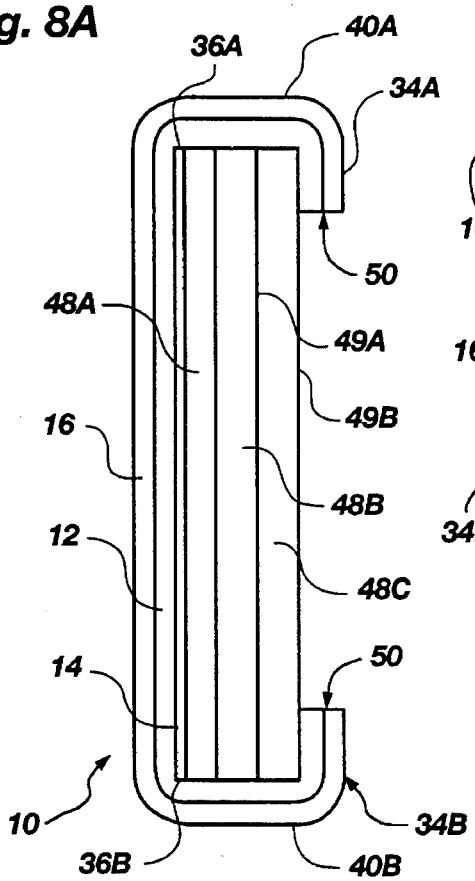

FIG. 8B is a blank of the liner 10. The widths 45A, 45B accommodate insertion of all or none of the buildup layers or thickness layers 48A, 48B, 48C under the tab portions 34A, 34B when folded to the configuration of FIG. 8C. For example, a double-sided, adhesive-coated, foamed polymer may be used for the adhesive layer 14. With addition of multiple adhesive layers 48A, 48B, 48C of such construction, a user may selectively adjust the effective circumference 25 of the sweatband 18 of the hat. Manufacturing may be simplified by making the liner 10 in a continuous strip cut to length 22, with the edges 50 folded by a user after exposing adhesive coated surfaces 49A, 49B of the first layer 14, or of added thickness layers 48A, 48B, 48C.

Figure 9A:
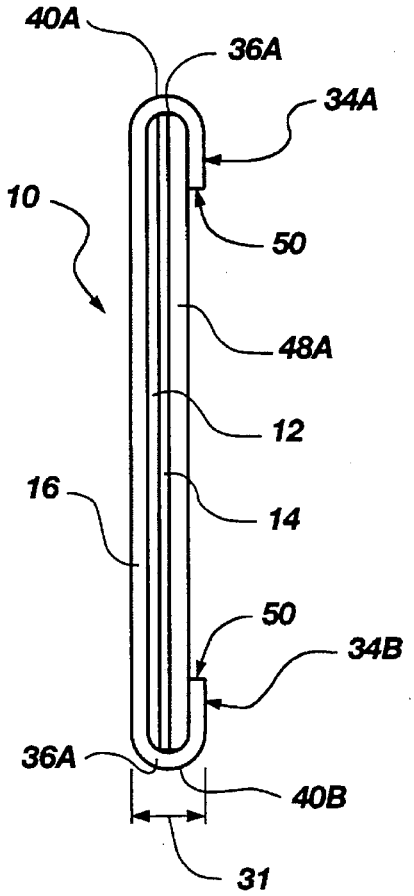
Figure 9B:
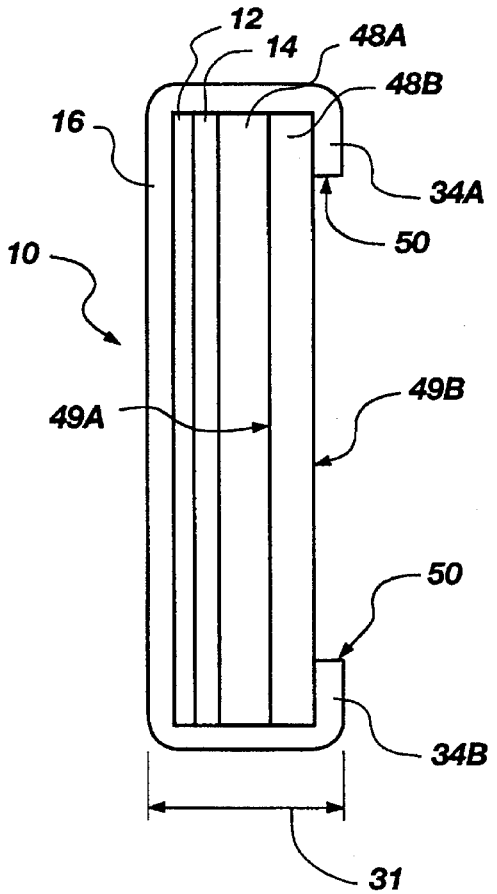

FIGS. 9A and 9B illustrate a liner 10 in which the tab portions 34A, 34B are formed only from the absorbing layer alone, to reduce effective thickness 31. Addition of the optional buildup layers 48A. 48B is illustrated in FIG. 9B. The configuration of FIG. 9B results from a blank 10 analogous to that shown in FIG. 8B.

Figure 10:
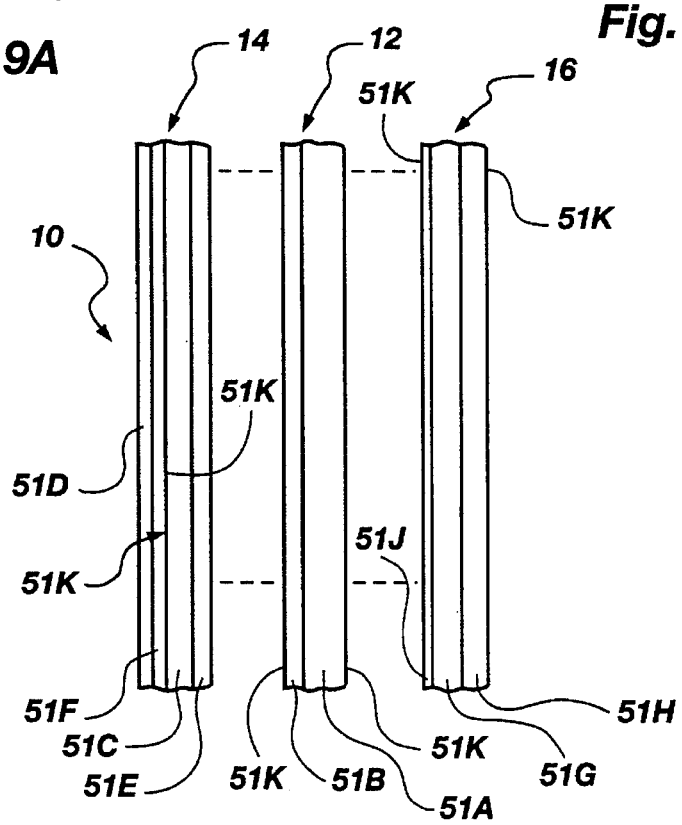
FIG. 10 is a cross-sectional end elevation view of an alternate embodiment of the invention having multi-laminate layers.

FIG. 10 illustrates how each of the layers 12, 14, 16 may itself be formed from multiple lamina 51A–51J to provide any individual feature (resilience, thickness, absorption and release of agents, absorption of moisture) in addition to another inconsistent feature (structural stability, high strength to weight ratio, high strength to volume ratio, imperviousness). For example, a resilient pad 51A may be backed with an impervious strip 5 1B. Likewise, the first layer 14 may be an adhesive material applied to the core 12, or a separate structural substrate (e.g. tape) having an adhesive applied to both sides (faces) 49A, 49B. Each structure has advantages in manufacturing and performance. Fewer materials and fewer structurally distinct layers 48A, 48B, 48C will usually reduce manufacturing costs. Additional layers 12, 14, 16, 48A, 48B, 48C facilitate customizing performance and physical characteristics of the liner 10. A substrate 51C may have adhesive coats 51D, 51E and an impervious layer 51F. The absorbing layer 16 may include an absorbent pad 51G of paper or other natural or synthetic fiber, including cotton, polyester, and polypropylene. A cover layer or stay-dry lining 51H may serve to keep liquids, preferentially wicked into and retained in the absorbent pad 51G, away from a user.

The absorbent pad 51G is preferably a wick for liquids, and may be formed of a variety of synthetic materials such as dacron, polyester and polypropylene used alone or in combination with natural fibers such as cotton and paper, whether in woven or non-woven fabrics. Natural materials may be used alone as well. An absorbent layer 16 may extend above the core 12 a distance 56, or above the core 12 and sweatband 18 a distance 57. The absorbent layer 16 may thus wick liquid away from the head of a user and from the hat 11 to be evaporated to maintain dryness. That is, the absorbent pad 51G is effective to wick liquids away from the user through the cover layer 51H. The cover layer 51H becomes a "stay-dry" type of lining to keep the absorbent pad 51G from releasing moisture to the hat 11 while promoting drawing moisture away from a user. Then, moisture can evaporate from the absorbing pad 51G as a vapor through the cover layer 51H without contacting the crown 20 and the hat 11.

An adhesive layer 51J may be required, or another bonding method such as heat or solvent between layers 12 and 16, or between pairs of faces 51K. Any or all of the lamina or layers 51A–51J may be included in a liner 10 of most embodiments of the invention.

A latex foam core 12 coated with a firm, permanently tacky adhesive as the adhering layer 14 and bonded to terry cloth as the absorbent layer 16, is preferred. An absorption 13A or antibacterial agent13B may be impregnated into the latex foam or the terry cloth to deodorize the liner 10. Charcoal is an excellent absorbing agent 13A for neutralizing odors.

Deodorizing agents, l3A, 13B, 13C Whether absorbent, anti-bacterial or fragrant, respectively, may be impregnated into the core 12, molded with the polymer, or applied to the core 12 or absorbent layer 16, each with a somewhat different result. For example, agents 13A, 13B, 13C disposed within closed cell foam may tend to operate or release faster than agents 13A, 13B, 13C in open cell foam. Likewise, agents 13A, 13B, 13C disposed in the fibers of a fabric or bat of the absorbent pad 51G may release faster than those in a polymeric foam core 12. Likewise, polymeric foams may release agents 13A, 13B, 13C or maintain them active over a longer period than would cotton, fabrics, paper and other materials of the absorbent layer 16.

Figure 11A:
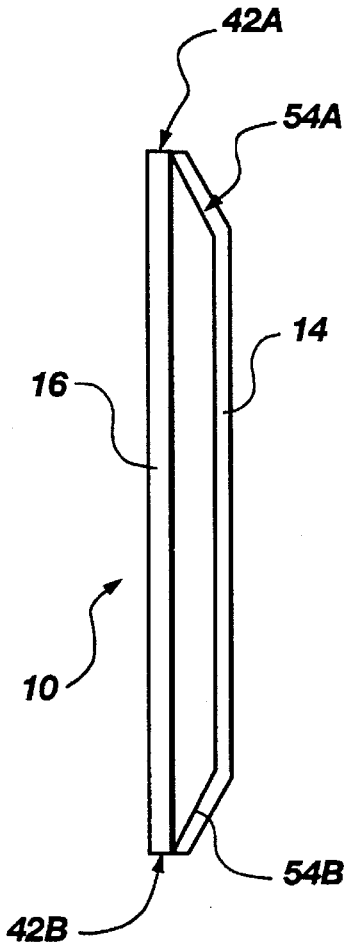
FIGS. 11A, 11B are a cross-sectional end elevation views of an alternate embodiment of the invention having beveled edges.
Figure 11B:
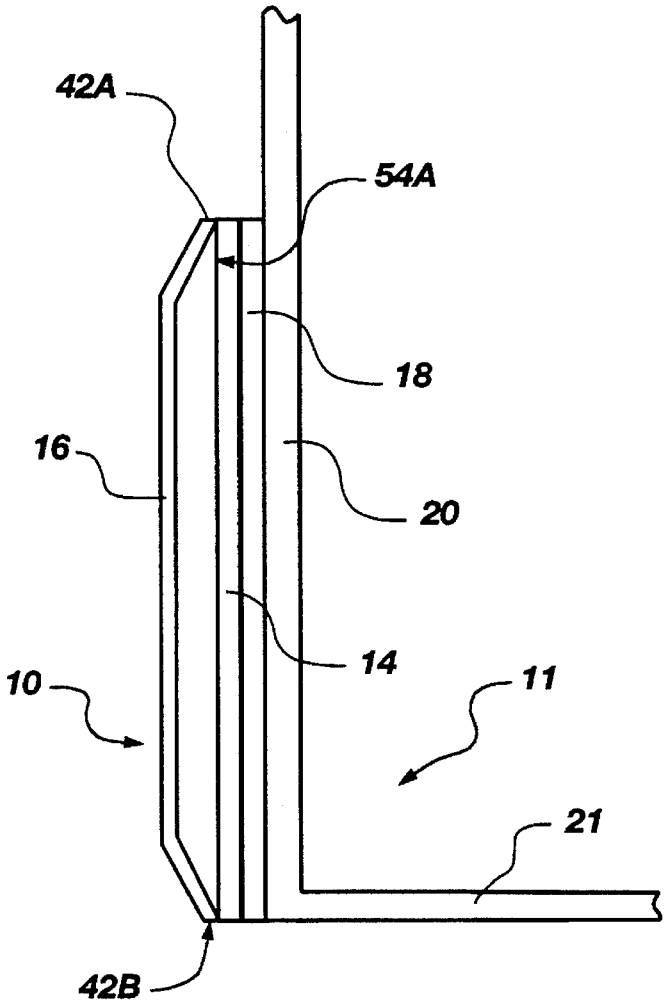

FIG. 11A illustrates a liner 10 having bevelled edges 54A, 54B, preferably formed prior to application of the adhering layer 14. If a substrate 51F is used, the bevelled edges 54A, 54B can be warped to fit flat against the adhering layer 14 which will hold the shape of the liner shown in FIG. 11B. Alternatively, the liner may appear as illustrated in FIG. 11A, and be installed by a user to appear as in FIG. 18B. In FIG. 11B, the liner 10 is positioned on the sweatband 18 inside the crown 20 of a hat 11. The core 12 bends along the bevelled edges 54A, 54B to conform to the sweatband 18. The adhering layer 14 secures the flexible core 12 and the absorbing layer 16, near the free edges 42A, 42B, to the sweatband 18.

INSTALLATION

Installation and prior adjustment or configuration of the liner 10 by a user is best understood by referring to FIGS. 1–11B, and particularly FIGS. 1–4D. The liner 10 may be installed in the hat 11 in a variety of orientations and by a variety of methods. The methods and orientations are not necessarily equivalent, each securing certain advantages and disadvantages to a user.

A tab portion 34A may be folded at a bend or fold 36A extending along the length 22 of the finer 10. A second tab portion 34B, or none at all, may be likewise folded. The tab portion 34A may be folded into place prior to installation or as part of installation of the liner 10. The tab portion 34A may be placed against the inside face 38A of the sweatband 18 or on the outside face 38B between the crown 20 and the sweatband 18. The resulting finished edge 40A may be positioned near the brim 21 or away from the brim 21.

The user may install a liner 10 in a hat 10 without modification prior to installation, if all configuration options have been exercised by the manufacturer. The sewn configurations of FIGS. 5C and 8A may be configured by a manufacturer, with the free edges 42A, 42B configured to be trimmed by a user in these as well as any embodiment having free edges 42A, 42B before installation. A distributor may stock numerous liners 10 in a variety of configurations, sizes and other optional parameters.

Alternatively, a user may configure the liner 10 prior to or during installation. For example, a user may trim the liner 10 of FIG. 4A to a desired width 26, starting with a standard blank. Likewise, the liner may be sold as a blank, (see e.g. FIGS. 6A–9B) to be configured by a user. For example, a user may fold the liners 10 as desired to achieve a specific width 26. Also, a configuration may require that a user select the length 46 of the tab portion 34A, 34B folded to alter the width 26 or effective thickness 31.

The alternate embodiments of FIGS. 8A, 8B, 8C, and 9B are configured to have multiple buildup layers 48, also identified individually as 48A, 48B, 48C. Thus the thickness 30 or effective thickness 31 of the liner 10 may be adjusted. As with the liners 10 having adjustable widths 26, some liners 10 may be trimmed at an edge 50 after adjustment of the thickness 30, but prior to folding and installation. For example, the embodiments of FIGS. 8A–9B may be adjusted in thickness 30 by application of thickness layers 48A, 48B, 48C as desired, and all but the liner 10 of FIG. 8A may be trimmed at the edges 50 prior to folding.

Referring to FIGS. 11A and 11B, the liner 10 or the core 12 may be bevelled on a back face 52 prior to application of the adhering layer 14. Upon installation of the adhering layer 14 against the sweatband 18, the bevelled edge 54 conforms to the sweatband 18 providing a finished appearance at the free edges 42A, 42B. The liner 10 has a small overall effective thickness 31 (profile) without the bulk of a folded tab portion 34A, 34B.

While preferred embodiments of the invention have been described with specific reference to the drawings, it should be understood that the invention is not thereby to be limited. Further it should be understood that the invention may be readily adapted for use in configurations different from those illustrated without departing from the invention.

What is claimed is:

1. A liner in combination with a hat, the liner having a thickness, the hat comprising a crown having a sweatband for fitting against the head of a user, and the liner comprising:

a core positionable on the sweatband of the hat, the core comprising a polymeric foam material, and having a first surface and a second surface;

a first layer positioned on the first surface for securing the core to the sweatband of the hat; and a second layer attached to the second surface for absorbing moisture.

2. The liner of claim 1, further comprising a tab extending from an edge of the liner to be foldable proximate a first surface of the liner.

3. The liner of claim 1, further comprising a buildup layer adjusting the thickness of the liner in the hat.

4. The liner of claim 1, wherein the first layer comprises an adhesive.

5. The liner of claim 1, wherein the polymeric foam material is comprised of closed cells.

6. The liner of claim 1, wherein the polymeric foam material is comprised of open cells.

7. The liner of claim 1, further comprising at least one deodorizing material applied to the liner for controlling odors.

8. The liner of claim 7, wherein the at least one deodorizing material is impregnated into the polymeric foam material.

9. The liner of claim 7, wherein the at least one deodorizing material is selected from the group consisting of odor absorbents and antibacterial agents.

10. The liner of claim 9, wherein the at least one deodorizing material is charcoal.

11. The liner of claim 1 wherein the second layer comprises a wicking material, and wherein the liner further comprises a cover layer positioned proximate the wicking material to inhibit liquids from leaving the wicking material as liquids.

12. The liner of claim 1, having a width and further comprising means for shaping the width of said liner by a user.

13. The liner of claim 7, further including an edge bevelled to fit substantially flush with the sweatband of the hat.

14. A liner in combination with a hat, the hat comprising a crown having a sweatband for fitting against the head of a user, and the liner comprising:

a core positionable on the sweatband of the hat, and having a first surface and a second surface;

a first layer positioned on the first surface for securing the core to the sweatband of the hat;

a second layer attached to the second surface for absorbing moisture; and a plurality of spacing layers selectively attachable to one another to alter thickness of the liner.

15. The liner of claim 14, wherein each spacing layer of the plurality of spacing layers has a first face and second face, the first and second faces having an adhesive disposed thereon.

16. A method for applying and removing a liner from a sweatband of a hat, the method comprising the steps of:

providing a liner having a core of polymeric foam formed to have a first surface and a second surface;

securing to the first surface a first layer having an adhesive surface for adhering to the sweatband;

securing to the second surface a second layer of absorbing material;

shaping the liner to fit the sweatband of the hat; and securing the first layer along a circumference of the sweatband.

17. The method of claim 16 wherein shaping includes selectively securing a tab portion of the liner to another portion of the liner.

18. The method of claim 16 wherein providing a liner further comprises providing the core impregnated with at least one deodorizing agent selected from a group consisting of odor absorbents and antibacterial agents.

19. The method of claim 16 further comprising removing the liner from the sweatband by applying tension between the first layer and the sweatband.

20. The method of claim 19 further comprising heating the liner to release the first layer from the sweatband.

* * * * *

UNITED STATES PATENT AND TRADEMARK OFFICE

CERTIFICATE OF CORRECTION

PATENT NO. : 5,566,395

DATED : October 22, 1996

INVENTOR(S) : Leonard R. Nebeker

It is certified that error appears in the above-identified patent and that said Letters Patent is hereby corrected as shown below:

In column 1, line 28, after "A" insert -- liner --.
In column 1, line 33, after "A" insert -- liner --.
In column 1, line 38, after "The" insert -- liner --.
In column 1, line 40, please delete "finer" and insert therefore -- liner --.
In column 1, line 56, please delete "robber" and insert therefore -- rubber --.
In column 4, line 24, replace "°" with -- . --.

In column 5, line 66, please delete "5 1B", and insert therefore -- 51B --.
In column 6, line 42, please insert a space after "agent".
In column 6, line 46, please omit comma after "agents".
In column 8, line 56, after "alter" insert -- a --.

Signed and Sealed this

Twenty-fifth Day of March, 1997

*Attest:*

Bruce Lehman

BRUCE LEHMAN

*Attesting Officer*

*Commissioner of Patents and Trademarks*